US010751604B1

(12) United States Patent
Ebacher et al.

(10) Patent No.: US 10,751,604 B1
(45) Date of Patent: Aug. 25, 2020

(54) MULTI-GAME FOLDABLE LOTTERY TICKET AND ASSOCIATED METHOD FOR MAKING

(71) Applicant: Scientific Games International, Inc., Newark, DE (US)

(72) Inventors: Mario Ebacher, Boucherville (CA); Marc Bedard, Repentigny (CA); Valérie Latreille, Carignan (CA); Claudia Lebrun, Montreal (CA); Yolaine Jodoin, Longueuil (CA); Gino Boucher, L'Epiphanie (CA); Graham Lee, Halifax (GB); Ian Bradley, Liversedge (GB); Andrew Naylor, Leeds (GB)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 16/436,464

(22) Filed: Jun. 10, 2019

(51) Int. Cl.
*A63F 3/06* (2006.01)
*B42D 25/27* (2014.01)

(52) U.S. Cl.
CPC ..... *A63F 3/0695* (2013.01); *A63F 3/0605* (2013.01); *A63F 3/069* (2013.01); *A63F 3/0655* (2013.01); *A63F 3/0665* (2013.01); *B42D 25/27* (2014.10)

(58) Field of Classification Search
CPC ..... A63F 3/0695; A63F 3/069; A63F 3/0655; A63F 3/0665; A63F 3/0605; B42D 25/27
USPC ..... 281/2, 5; 283/67, 70, 72, 74, 94, 98, 283/903; 273/269; 463/17
See application file for complete search history.

(56) References Cited

U.S. PATENT DOCUMENTS

| | | | | |
|---|---|---|---|---|
| 4,033,611 | A * | 7/1977 | Johnsen | A63F 3/069 283/101 |
| 6,145,885 | A | 11/2000 | Scrymgeour et al. | |
| 7,712,741 | B2 | 5/2010 | Lambert | |
| 10,166,462 | B2 | 1/2019 | Friesen et al. | |
| 2006/0290136 | A1 * | 12/2006 | Alasia | G07D 7/128 283/72 |
| 2012/0228861 | A1 * | 9/2012 | Friesen | A63F 3/0665 283/101 |

* cited by examiner

*Primary Examiner* — Justin V Lewis
(74) *Attorney, Agent, or Firm* — Dority & Manning, P.A.

(57) ABSTRACT

A multi-game ticket assembly and associated method of making include a substrate having a front surface and a back surface. A first game play area is provided on the front surface and includes a plurality of game symbols for play of a first game. A second game play area is provided on the back surface and includes one or more windows defined therein for play of a second game partially embodied on the back surface. A fold line indication on the front surface and divides the substrate into a first portion and a second portion. The second portion is foldable onto the first portion in a folded state of the substrate such that the front surface of the second portion is against the front surface of the first portion and the one or more windows align with the first game play area. The game symbols in the first game play area that are visible to a player through the one or more windows in the folded state of the substrate determine an outcome of the second game.

16 Claims, 4 Drawing Sheets

MULTI-GAME FOLDABLE LOTTERY TICKET AND ASSOCIATED METHOD FOR MAKING

FIELD OF THE INVENTION

The present invention relates generally to the field of game tickets, such as lottery game tickets, and more particularly to a multi-game lottery ticket having a back-side game integrated with a front-side game on a common substrate.

BACKGROUND

A common type of lottery game ticket is known as a "scratch-off" ticket wherein one or more game plays are printed onto a front surface of a card stock. The player scratches off an opaque layer in a game play area of the ticket to reveal underlying indicia that dictates whether or not the ticket is a winner. Such game tickets are also referred to as "scratch-off" tickets.

Various efforts have been made in the industry to combine multiple scratch-off games on a single ticket or within a ticket assembly. For example, scratch-off lottery tickets are known wherein one or more games are provided on a front surface of the ticket and a separate game is provided on a back surface of the ticket, such as the ticket construction and method disclosed in U.S. Pat. No. 7,712,741

Attempts have also been made in the industry to bundle or combine multiple instant-win tickets into a single package that is sold to the player. For example, U.S. Pat. No. 6,145,885 describes a lottery ticket construction wherein the rear surface of a first continuous substrate in strip form is adhered to the rear surface of a second continuous substrate in strip form to form a row of connected tickets with a line of weakness between each ticket. Game play indicia for each ticket is printed onto the rear surface of the first strip and is accessible via pull-tab windows defined in the second strip. The combined strips are fan-folded along the lines of weakness.

In a different multi-game ticket configuration, a plurality of individual tickets are joined at an edge to form a "book" of tickets. For example, the Iowa State Lottery offers a "Game Book" containing six separate pages with eight separate scratch-off games for a $20 purchase price.

U.S. Pat. No. 10,166,462 describes a lottery ticket having a first game play area printed on a front surface of the ticket substrate and a second game play area printed on the back surface of the ticket, with each of the first and second game play areas containing game play symbols and a scratch-off material covering at least a part of each game play area which can be removed by the player for playing of the game by the player. The first game play area is arranged relative to the game play information to allow playing by the player of the game symbols on the first play area. The ticket substrate is arranged to provide movement of the second game play area relative to the game play information to allow playing by the player of the game symbols on the second play area. The second game play area is moved by folding of the ticket substrate, or by removing one piece of the ticket from another and to juxtapose the two pieces in a different arrangement.

The types of multi-game or multi-ticket constructions discussed above involve the handling and processing of multiple substrates or the printing of game play areas and scratch-off coatings on both sides of the ticket, which can be complicated and expensive.

Therefore, it is highly desirable to develop multi-game ticket configuration that appeals to consumers, uses the "real estate" on both sides of the ticket substrate, and is cost effective to produce from a single substrate.

SUMMARY OF THE INVENTION

Objects and advantages of the invention will be set forth in part in the following description, or may be obvious from the description, or may be learned through practice of the invention.

In accordance with aspects of the invention, a multi-game ticket assembly is provided that includes a substrate having a front surface and a back surface. A first game play area is printed on the front surface and includes a plurality of game symbols for play of a first game. In a particular embodiment, the first game is completely embodied on the front surface in that all instructions, indicia, game symbols, and so forth, necessary for a player to complete the first game are provided on the front surface. A second game play area is provided on the back surface of the substrate and includes one or more windows defined therein for play of a second game that is partially embodied on the back surface and partially embodied on the front surface. A fold line is indicated on the front surface that divides the substrate into a first portion and a second portion, wherein the second portion is foldable onto the first portion in a folded state of the substrate such that the front surface of the second portion is against the front surface of the first portion. In this folded state, the second game play area is presented to the player and the one or more windows in the second game play area align with the first game play area. The game symbols in the first game play area that are visible to a player through the one or more windows in the folded state of the substrate are used to play and determine an outcome of the second game.

In a particular embodiment, a scratch-off coating covers the game symbols in the first game play area, wherein the scratch-off coating is removable by the player through the one or more windows to reveal the game symbols in the first game play area that determine the outcome of the second game.

The game symbols in the first game play area may be used to play both of the first game and the second game. In other words, the same game symbols may determine the outcome in both games. In an alternate embodiment, the game symbols used to play the second game are not used to play the first game. In other words, separate distinct sets of game symbols are contained in the first game play area (one set for play of each game).

A plurality of game symbol locators may be provided on the front surface that direct the player to the game symbols in the first game play area to be used to play the first game. For example, if all of the game symbols are covered by the scratch-off coating, the game symbol locators may direct the player to location of certain game symbols to be uncovered to determine the outcome of the first game. The game symbol locators may also be covered by a scratch-off coating.

In one embodiment, the game symbols may be provided in a grid in the first game play area, wherein the game symbol locators identify locations within the grid corresponding to the game symbols used to play the first game (and that determine the outcome of the first game). In this embodiment, the one or more windows can be located in the second game play area so as to align with one or more grid locations within the grid that have the game symbols needed to play the second game (and determine the outcome of the second game).

The one or more windows in the second game play area can be provided in various ways. In a particular embodiment, the windows are defined by perforated pop-out sections of the substrate that are removable by the player before or after folding of the substrate along the fold line. In another embodiment, the windows may be provided by a film or other type of material that the player can poke or cut through. Alternatively, the windows may be defined by completely open sections in the substrate without manipulation or action by the player.

The ticket assembly may include a first prize legend on the front surface that indicates one or more prizes for the first game depending on the game symbols in the first game play area, and a second prize legend on the back surface that indicates one or more prizes for the second game depending on the game symbols in the first game play area that are visible through the one or windows.

The present invention also encompasses a method for producing a multi-game ticket assembly, including providing a first game play area on a front surface of a substrate for play of a first game by a player, the first game play area comprising a plurality of game symbols for play of a first game embodied on the front surface. The method further includes providing a second game play area on a back surface of the substrate for play of a second game. An indication is provided on the front surface of the substrate for the player to fold the substrate such that portions of the front surface of the substrate are facing and the second game play area is visible to the player. The method includes providing one or more windows in the second game play area that align with one or more of the game symbols in the first game play area in the folded state of the substrate that are used to play the second game, which has a separate prize structure from the first game.

The method may include providing a scratch-off coating over the game symbols in the first game play area, wherein the scratch-off coating is removable by the player through the one or more windows to reveal the game symbols in the first game play area that are used to play and determine the outcome of the second game.

Various other embodiments of the method may include providing any one or combination of the features discussed above with respect to the ticket assembly

DETAILED DESCRIPTION

Reference will now be made in detail to examples of the present invention, one or more embodiments of which are illustrated in the figures. Each example is provided by way of explanation of the invention, and not as a limitation of the invention. For instance, features illustrated or described with respect to one embodiment may be used with another embodiment to yield still a further embodiment. It is intended that the present application encompass these and other modifications and variations as come within the scope and spirit of the invention.

Figure 1B:
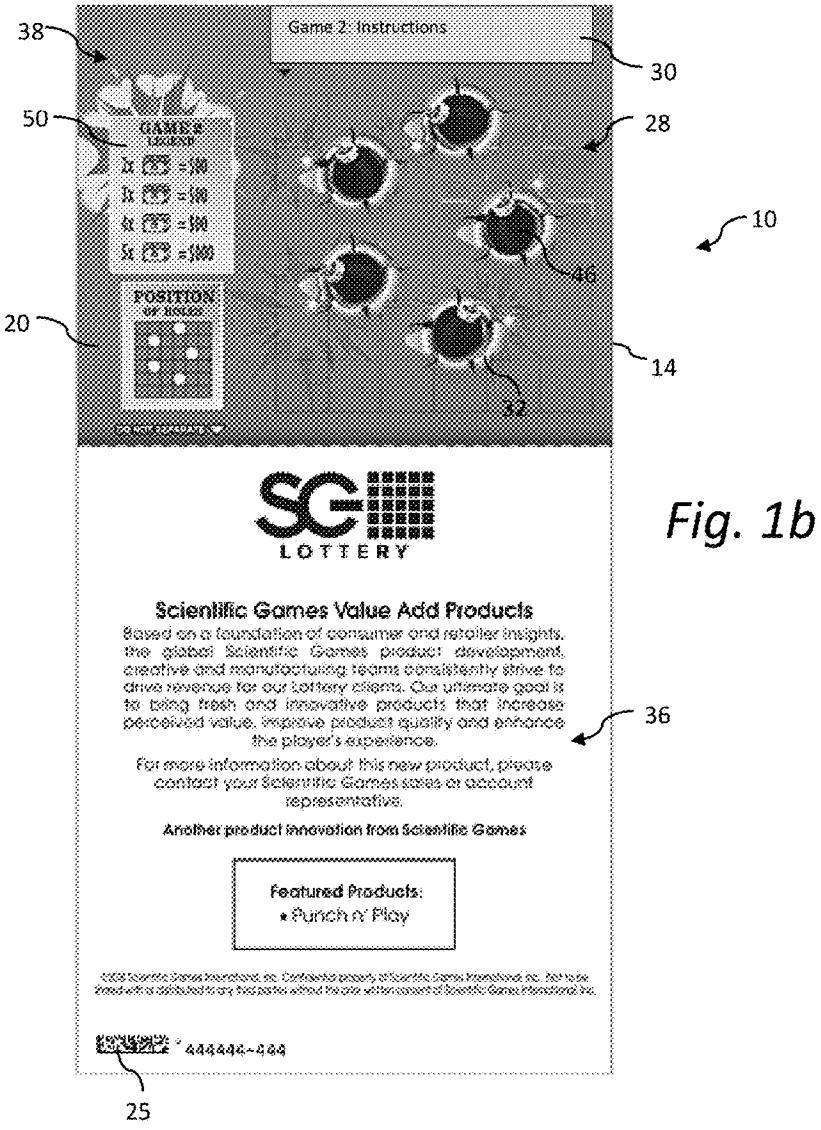
FIG. 1*b* is a back or rear aspect view of the multi-game ticket assembly of FIG. 1.
Figure 1A:
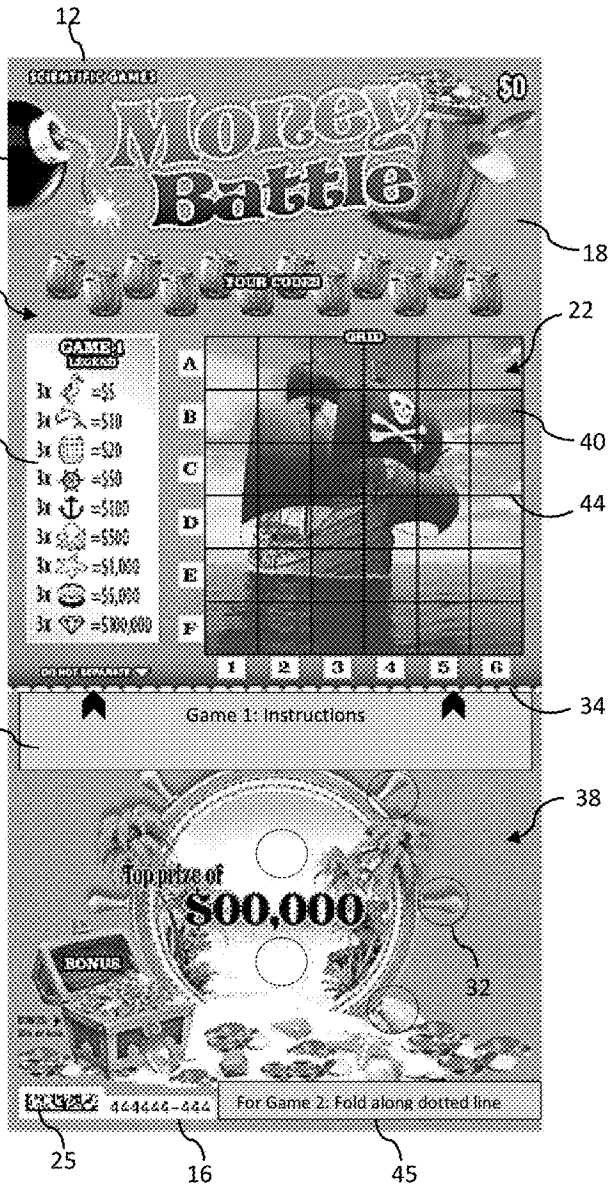
FIG. 1*a* is a front aspect view of a multi-game ticket assembly in accordance with aspects of the invention.

Referring to FIGS. 1*a* and 1*b*, a multi-game ticket assembly 10 is illustrated. The ticket assembly 10 is "multi-game" in that at least two separate games are embodied on the ticket, with each game having its own prize structure and capable of being played without having to play or complete the other respective game.

The ticket assembly 10 is formed from a single continuous substrate 12, such as a continuous strip of card stock or paper board substrate. It should be appreciated that the invention is not limited by the materials used to form the substrate 12. The substrate 12 includes a front surface 18 and a back surface 20 defined by side edges 14 and end edges 16. FIG. 1*a* depicts the front surface 18 and FIG. 1*b* depicts the back surface 20 as presented to a player. Each surface or face 18, 20 includes any manner of game-related indicia, such as graphics and wording, to describe and provide instructions to the player about the separate games embodied by the ticket assembly 10. It should be appreciated that the ticket assembly 10 is not limited by any particular type or manner of game-related indicia, or the method of printing such indicia thereon. The game ticket assembly 10 may include a QR code 25 or other type of machine-readable code that may serve any number of functions known to those skilled in the art, such as ticket serial number, verification, redemption, security functions, and the like.

Referring to FIG. 1*a*, a first game play area 22 is provided on the front surface 18 of the ticket assembly 10 for play of a first game, which may be any manner of scratch-off lottery game. As is well known in the art, scratch-off lottery games generally entail providing game symbols under a scratch-off coating, wherein the player removes the scratch-off coating to determine a number of matching game symbols or matches between the uncovered game symbols and a set of player symbols. One or more matches can indicate a winning game play with a variable prize structure depending on the number of matches.

It should be understood that the present multi-game ticket assembly 10 is not limited by the type or theme of scratch-off game or games embodied thereon.

Figure 2:
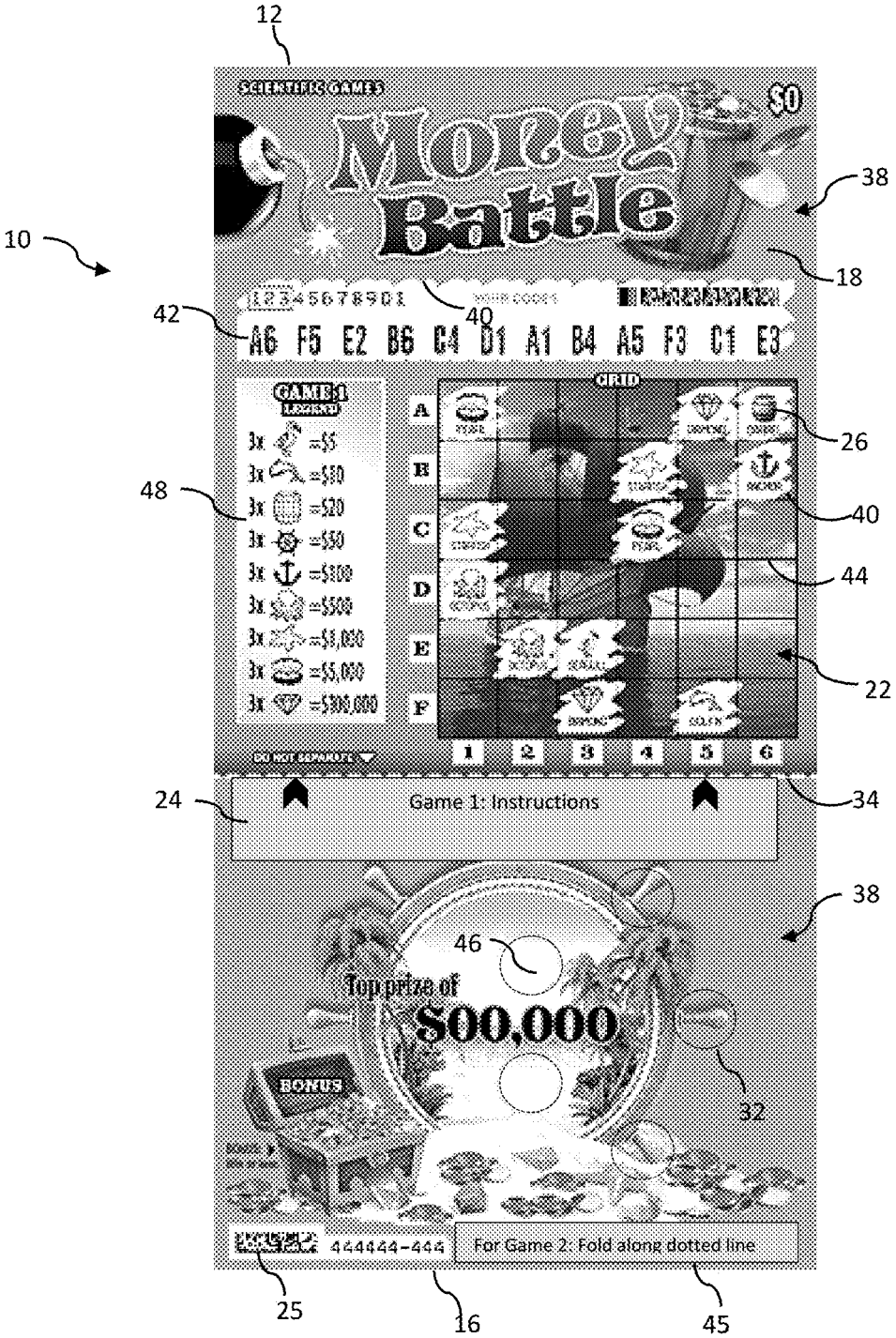
FIG. 2 is a front aspect view of the multi-game ticket assembly of FIG. 1*a* depicting removal of a scratch-off coating from game symbols in the first game play area.

In the particular embodiment of FIG. 1*a*, the game symbols are "hidden" by the scratch-off coating 40. FIG. 2 depicts removal of the scratch-off coating 40 to reveal certain ones of the underlying game symbols 26. FIG. 2 also depicts a plurality of game symbol locators 42 that are revealed to the player upon removal of the overlying scratch-off coating 40, as is appreciated by comparing FIG. 1*a* and FIG. 2. Each of these locators 42 identifies a location on a grid 44 in the first game play area 22, wherein the player removes the coating 40 from each of grid position identified by the game symbol locators 42. The number of matching, uncovered game symbols 26 within the grid 44 determines the prize (if any), as indicated by the first game legend 48 provided on the front surface 18. A first set of game instructions 24 are provided on the front face 18 that inform the player of how to play the first game.

It is thus appreciated that, in the embodiment of the first game depicted in the figures, the first game is embodied completely on the front surface 18 of the multi-game ticket assembly 10 in that all instructions, indicia, game symbols, and so forth, necessary for a player to complete the first game are provided on the front surface 18.

Referring again to FIGS. 1*a* and 1*b*, a second game play area 28 provided on the back surface 20 of the substrate 12 for play of a second game that is only partially embodied on the back surface 20. Reference must be made to the game symbols 26 in the first game play area 22 on the front surface 18 in order for the player to complete the second game. For this purpose, one or more windows 32 are defined in the second game play area 28, as described in greater detail below.

A fold line 34 is indicated to the player on the front surface 18, which may be a perforated or scored line. The fold line 34 divides the substrate 12 into a first portion 36 and a second portion 38. In the particular multi-game ticket assembly 10 depicted in the figures, the first portion 36 is an upper portion and the second portion 38 is a lower portion when viewing the front surface 20, as seen in FIG. 1*a*. In alternate embodiments, the first portion 36 and second portion 38 may be side-by-side portions.

FIG. 1*b* depicts the back side 20 after the substrate 12 has been flipped over and rotated by 180 degrees. Thus, from the view of the back side 20, the second portion 38 is above the first portion 36.

Figure 3A:
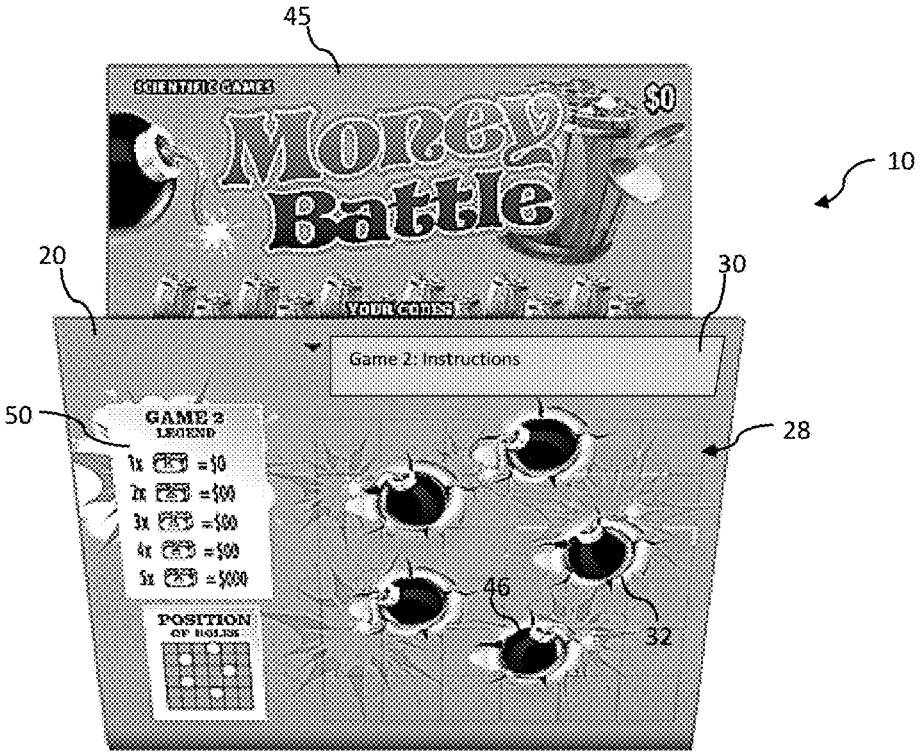
FIG. 3*a* is a front aspect view of the multi-game ticket assembly of FIG. 1*a* partially folded so that the second game play area on the back side of the multi-game ticket assembly view of FIG. 1*b* is presented to the player.
Figure 3B:
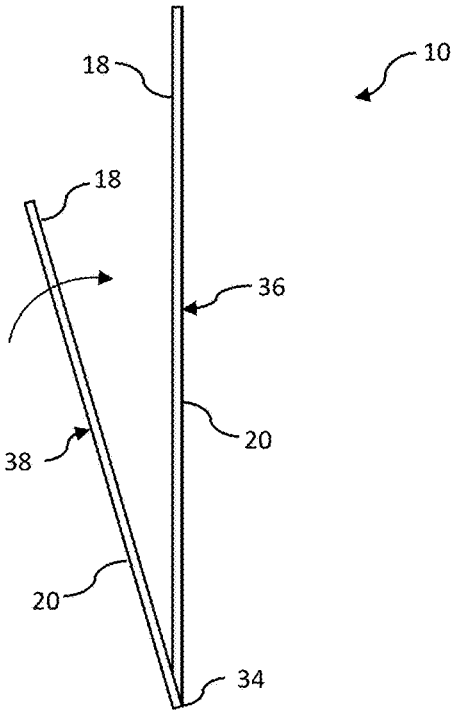
FIG. 3*b* is a side view indicating the folding direction of the multi-game ticket assembly of FIG. 3*a;*

Indicia 45 is provided on the front surface 18 instructing the player to fold the substrate 12 along the fold line 34 for play of the second game such that, in a folded state of the substrate 12, the front surface 18 of the second portion 38 is against the front surface 18 of the first portion 36, as particularly depicted in FIG. 3*b*.

Figure 5:
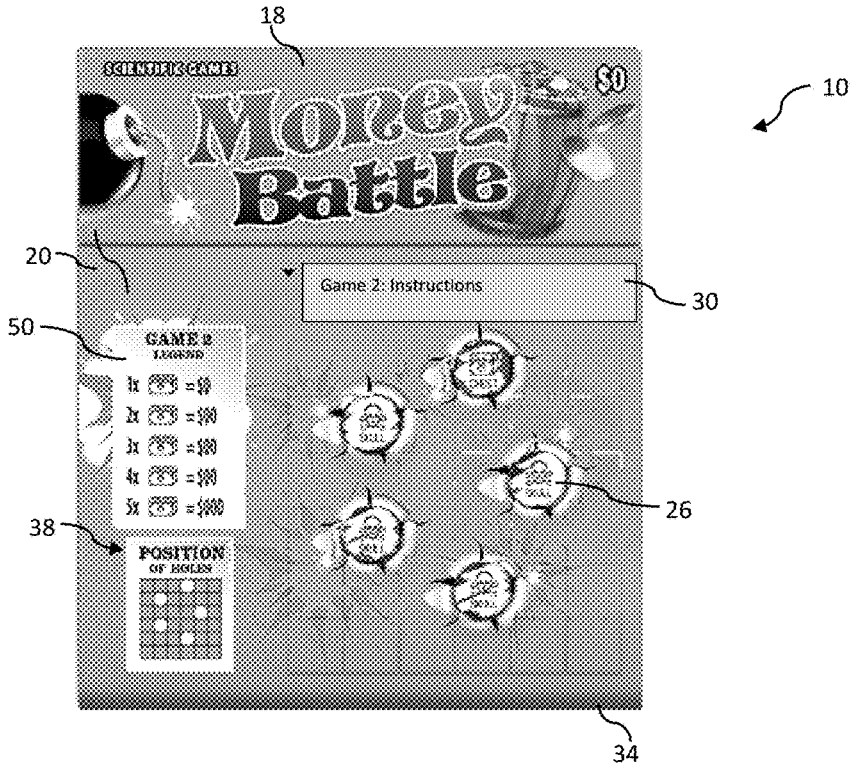
FIG. 5 is a front aspect view of the multi-game ticket assembly of FIG. 4 in a completely folded state wherein the windows align with game symbols in the first game play area.

The windows 32 in the second game play area 28 are provided in a pattern so as to align with particular ones of the game symbols 26 in the first game play area 22 once the first 36 and second 38 ticket portions have been folded, as particularly seen in FIG. 5. These game symbols 26 that are visible to a player through the one or more windows 32 in the folded state of the substrate 12 determine an outcome of the second game. For example, in the depicted embodiment, a second prize legend 50 on the back surface 20 of the substrate 12 indicates how many matching game symbols 26 in the windows 32 are needed for a win in a variable prize structure.

The second game may be designed such that the windows 32 align with game symbol locations in the first game play area 22 that were not uncovered for play of the first game. For example, in the depicted embodiment wherein the game symbols 26 are disposed within a grid 44 in the first game play area 22, the windows 32 are located in the second game play area 28 so as to align with one or more grid locations within the grid 44 that contain the game symbols 26 needed to play and determine the outcome of the second game and which are still covered by scratch-off coating 40. This provides the player with the gaming experience of removing the scratch-off coating 40 through the windows 32 to reveal the underlying game symbols 26 and the outcome of the second game, as depicted in FIG. 5. Thus, in this embodiment, the game symbols 26 used in play of the second game are not used for play of the first game and can remain covered by the scratch-off coating 40.

However, in an alternate embodiment, the game symbols 26 may be used for play of both games, wherein the game symbols are uncovered in play of the first game and are also used in play of the second game, for example by being identified or isolated by the position of the windows 32.

Figure 4:
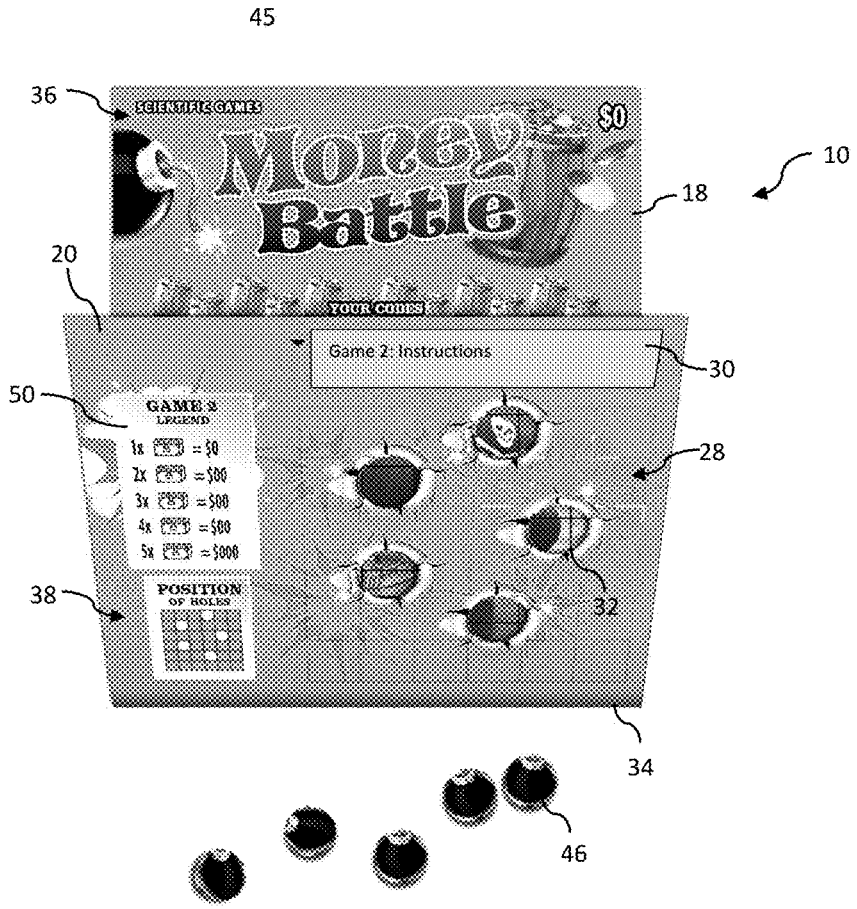
FIG. 4 is a front aspect view of the multi-game ticket assembly of FIG. 3*a* with the pop-out sections of the substrate removed to provide the windows in the second game play area.

The windows 32 in the second game play area 22 can be provided in various ways. In a particular embodiment illustrated in the figures, the windows 32 are defined by perforated pop-out sections 46 in the substrate 12 that are readily removable by the player before or after folding of the substrate 12 along the fold line 34. FIG. 4 depicts the pop-out sections 46 removed prior to complete folding of the second portion 38 onto the first portion 36. In another embodiment, the windows 32 may be provided by an opaque film or other type of material that the player can poke or cut through. Alternatively, the windows 32 may be defined by completely open sections in the substrate 12 without manipulation or action by the player.

As mentioned above, and supported in the description and figures, the present invention also encompasses various method embodiments for making the multi-game ticket assembly 10 described above. For example, a method is provided for producing a multi-game ticket assembly and includes the step of providing a first game play area on a front surface of a substrate for play of a first game by a player, the first game play area comprising a plurality of game symbols for play of a first game. The method includes providing a second game play area on a back surface of the substrate for play of a second game. An indication is provided on the front surface of the substrate for the player to fold the substrate such that portions of the front surface of the substrate are facing and the second game play area is visible to the player in the folded state of the ticket. One or more windows are defined in the second game play area that align with one or more of the game symbols in the first game play area in the folded state of the substrate, wherein the game symbols that are isolated or identified by the windows are used to play the second game. The second game is separate from the first game and has its own separate prize structure.

One embodiment of the method may include providing a scratch-off coating over the game symbols in the first game play area, wherein the scratch-off coating is removable by the player through the one or more windows to reveal the game symbols in the first game play area that are used to play and determine the outcome of the second game.

The method may include arranging the game symbols in the first game play area such that the game symbols used to play the second game are not used to play the first game.

Another method embodiment may include providing a plurality of game symbol locators on the front surface that direct the player to the game symbols that are used to play the first game. For example, the game symbols may be arranged in a grid and covered by a scratch-off coating, wherein the game symbol locators identify grid positions to the player. This embodiment may include locating the windows in the second game play so as to align with one or more of the grid locations that have the game symbols used to play the second game.

The method may include defining the windows in the second game play area in various manners. For example, the windows may be defined by perforated pop-out sections of the substrate that are removable by the player before or after folding of the substrate along the fold line.

It should be readily appreciated that the present invention may incorporate any known and conventional method for printing instant scratch-off lottery tickets onto a substrate. Such tickets may include any feature of conventional scratch-off lottery tickets.

What is claimed is:

1. A multi-game ticket assembly, comprising:

a substrate comprising a front surface and a back surface;

a first game play area provided on the front surface, the first game play area comprising a plurality of game symbols for play of a first game, the game symbols in the first game play area being covered by a scratch-off coating;

a second game play area provided on the back surface, the second game play area comprising one or more windows defined therein for play of a second game partially embodied on the back surface;

a fold line displayed on the front surface, the fold line dividing the substrate into a first portion and a second portion;

the second portion foldable onto the first portion in a folded state of the substrate such that the front surface of the second portion is against the front surface of the first portion and the one or more windows align with the first game play area; and wherein the scratch-off coating is removable by a player through the one or more windows to reveal the game symbols in the first game play area to determine an outcome of the second game.

2. The multi-game ticket assembly as in claim 1, wherein the game symbols in the first game play area used to play the second game are not used to play the first game.

3. The multi-game ticket assembly as in claim 1, wherein a plurality of game symbol locators are provided on the front surface that direct the player to the game symbols to be uncovered to play the first game.

4. The multi-game ticket assembly as in claim 3, wherein the game symbol locators are covered by a scratch-off coating.

5. The multi-game ticket assembly as in claim 3, wherein the game symbols are provided in a grid in the first game play area, the game symbol locators identifying locations within the grid corresponding to the game symbols used to play the first game.

6. The multi-game ticket assembly as in claim 5, wherein the one or more windows are located in the second game play area so as to align with one or more grid locations within the grid that have the game symbols needed to play the second game.

7. The multi-game ticket assembly as in claim 1, wherein the one or more windows are defined by perforated pop-out sections of the substrate that are removable by the player before or after folding of the substrate along the fold line.

8. The multi-game ticket assembly as in claim 1, further comprising a first prize legend on the front surface that indicates one or more prizes for the first game, and a second prize legend on the back surface that indicates one or more prizes for the second game.

9. A method for producing a multi-game ticket assembly, comprising:

providing a first game play area on a front surface of a substrate for play of a first game by a player, the first game play area comprising a plurality of game symbols for play of a first game, the game symbols in the first game play area being covered by a scratch-off coating;

providing a second game play area on a back surface of the substrate for play of a second game;

providing a fold line on the front surface of the substrate to indicate to the player to fold the substrate along the fold line such that portions of the front surface of the substrate are facing and the second game play area is visible to the player; and providing one or more windows in the second game play area that align with one or more of the game symbols in the first game play area in a folded state of the substrate that are used to play the second game, wherein the scratch-off coating is removable by the player through the one or more windows to reveal the game symbols in the first game play area to determine an outcome of the second game; and wherein the second game has a separate prize structure from the first game.

10. The method as in claim 9, wherein the game symbols in the first game play area used to play the second game are not used to play the first game.

11. The method as in claim 9, wherein a plurality of game symbol locators are provided on the front surface that direct the player to the game symbols that are used to play the first game.

12. The method as in claim 11, further comprising providing a scratch-off coating over the game symbol locators.

13. The method as in claim 11, wherein the game symbols are provided in a grid in the first game play area, the game symbol locators identifying locations within the grid corresponding to the game symbols used to play the first game.

14. The method as in claim 13, wherein the one or more windows are located in the second game play area so as to align with one or more grid locations within the grid that have the game symbols used to play the second game.

15. The method as in claim 9, wherein the one or more windows are defined by perforated pop-out sections of the substrate that are removable by the player before or after folding of the substrate along the fold line.

16. The method as in claim 9, further comprising providing a first prize legend on the front surface that indicates one or more prizes for the first game, and a second prize legend on the back surface that indicates one or more prizes for the second game.

* * * * *